US007249021B2

(12) United States Patent
Morio et al.

(10) Patent No.: US 7,249,021 B2
(45) Date of Patent: Jul. 24, 2007

(54) SIMULTANEOUS PLURAL-VOICE TEXT-TO-SPEECH SYNTHESIZER

(75) Inventors: Tomokazu Morio, Nara (JP); Osamu Kimura, Yamatokooriyama (JP)

(73) Assignee: Sharp Kabushiki Kaisha, Osaka (JP)

( * ) Notice: Subject to any disclaimer, the term of this patent is extended or adjusted under 35 U.S.C. 154(b) by 935 days.

(21) Appl. No.: 10/451,825

(22) PCT Filed: Dec. 27, 2001

(86) PCT No.: PCT/JP01/11511

§ 371 (c)(1),
(2), (4) Date: Jun. 26, 2003

(87) PCT Pub. No.: WO02/054383

PCT Pub. Date: Jul. 11, 2002

(65) Prior Publication Data

US 2004/0054537 A1 Mar. 18, 2004

(30) Foreign Application Priority Data

Dec. 28, 2000 (JP) ..... 2000-400788

(51) Int. Cl.

| | |
|---|---|
| ***G10L 13/00*** | (2006.01) |
| ***G10L 13/02*** | (2006.01) |
| ***G10L 13/06*** | (2006.01) |
| ***G10L 13/08*** | (2006.01) |

(52) U.S. Cl. ..... 704/258; 704/260; 704/259

(58) Field of Classification Search ..... 704/258, 704/259, 260

See application file for complete search history.

(56) References Cited

U.S. PATENT DOCUMENTS 5,384,893 A * 1/1995 Hutchins ..... 704/267

(Continued)

FOREIGN PATENT DOCUMENTS

JP 60-21098 A 2/1985

(Continued)

OTHER PUBLICATIONS

A. Kain, "Sprectral voice conversion for text-to-speech synthesis", May 12-15, 1998, Procedings of the 1998 IEEE International Conference on: Acoustic, Speech, and Signal Processing, vol. 1, pp. 285-288.*

(Continued)

*Primary Examiner*—Tālivaldis Ivars Šmits
*Assistant Examiner*—Abdelali Serrou
(74) *Attorney, Agent, or Firm*—Birch, Stewart, Kolasch & Birch, LLP

(57) ABSTRACT

A multiple-voice instructing unit (17) instructs pitch deforming ratio and mixing ratio to a multiple-voice synthesis unit (16). The multiple voice synthesis unit (16) generates a standard voice signal by means of waveform superimposition based on voice element data read from a voice element database (15) and prosodic information from a voice element selecting unit (14), expands/contracts the time base of the above standard voice signal based on the prosodic information and instruction information from the multiple-voice instructing unit (17) to change a voice pitch, and mixes the standard voice signal with an expansion/contraction voice signal for outputting via an output terminal (18). Accordingly, a concurrent vocalization by multiple speakers based on the same text can be implemented without the need of time-division, parallel text analyzing and prosody generating and of adding pitch converting as post-processing.

18 Claims, 6 Drawing Sheets

U.S. PATENT DOCUMENTS

| | | | | |
|---|---|---|---|---|
| 5,715,368 | A * | 2/1998 | Saito et al. | 704/268 |
| 5,774,855 | A * | 6/1998 | Foti et al. | 704/267 |
| 5,787,398 | A * | 7/1998 | Lowry | 704/268 |
| 6,101,470 | A * | 8/2000 | Eide et al. | 704/260 |
| 6,253,182 | B1 * | 6/2001 | Acero | 704/268 |
| 6,470,316 | B1 * | 10/2002 | Chihara | 704/267 |
| 6,490,562 | B1 * | 12/2002 | Kamai et al. | 704/258 |
| 6,499,014 | B1 * | 12/2002 | Chihara | 704/260 |
| 6,665,641 | B1 * | 12/2003 | Coorman et al. | 704/260 |
| 6,823,309 | B1 * | 11/2004 | Kato et al. | 704/267 |

FOREIGN PATENT DOCUMENTS

| | | | |
|---|---|---|---|
| JP | 1-169879 | U | 11/1989 |
| JP | 3-211597 | A | 9/1991 |
| JP | 5-257494 | A | 10/1993 |
| JP | 6-75594 | A | 3/1994 |
| JP | 8-123455 | A | 5/1996 |
| JP | 8-129398 | A | 5/1996 |
| JP | 9-244693 | A | 9/1997 |
| JP | 10-124292 | A | 5/1998 |
| JP | 1-197793 | A | 8/1998 |
| JP | 10-290225 | A | 10/1998 |
| JP | 11-243256 | A | 9/1999 |
| JP | 2000-10580 | A | 1/2000 |
| JP | 2002-23778 | A | 1/2002 |
| JP | 2002-23787 | A | 1/2002 |

OTHER PUBLICATIONS

C. Turek, "The development of a connectionist multiple-voice text-to-speech system", Apr. 14-17, 1991, International Conference on Acoustics, Speech, and Signal Processing, vol. 2, pp. 749-752. □□.*

"Basic Speech Information Processing", OHMSHA, pp. 76-77.

* cited by examiner

Fig.3A
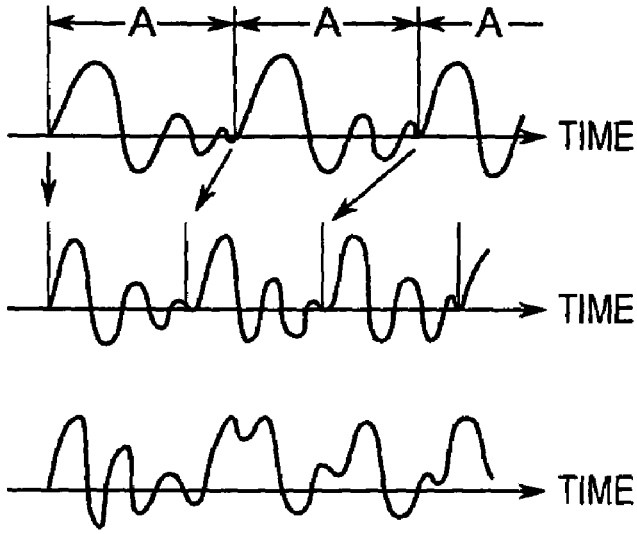
Fig.3B
Fig.3C
Fig.4
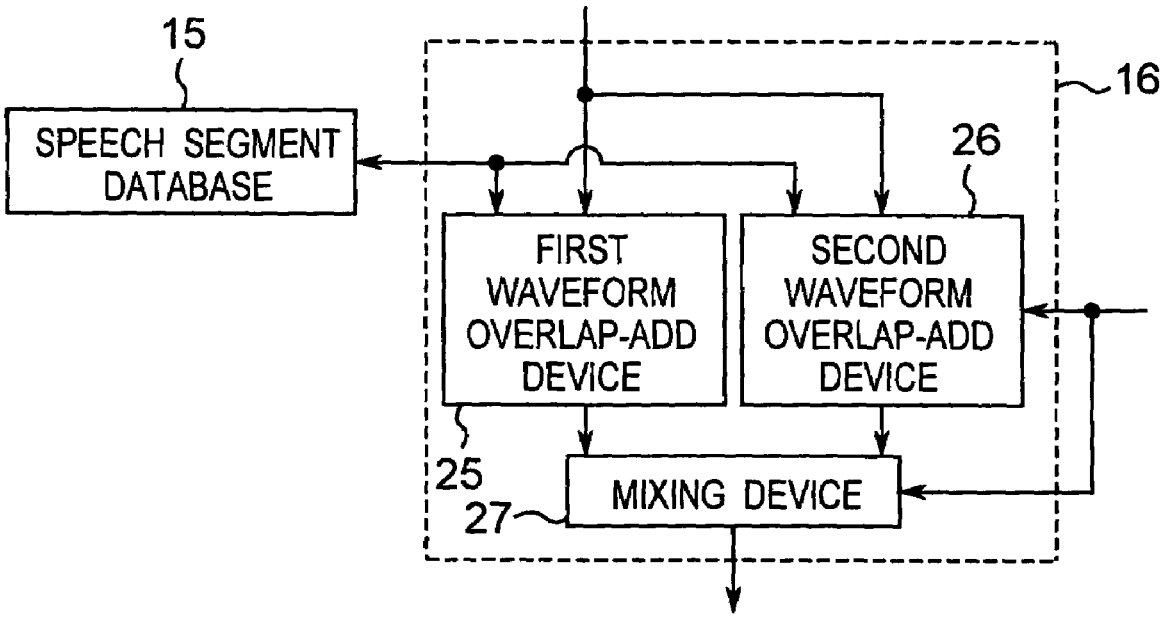

SIMULTANEOUS PLURAL-VOICE TEXT-TO-SPEECH SYNTHESIZER

This application is the national phase under 35 U.S.C. 371 of PCT International Application No. PCT/JP01/11511 which has an International filing date of Dec. 27, 2001, which designated the United States of America.

TECHNICAL FIELD

The present invention relates to a text-to-speech synthesizer for generating a synthetic speech signal from a text and to a program storage medium for storing a text-to-speech synthesis processing program.

BACKGROUND ART

FIG. 11 is a block diagram showing the configuration of a general text-to-speech synthesizer. The text-to-speech synthesizer is mainly composed of a text input terminal 1, a text analyzer 2, a prosody generator 3, a speech segment selector 4, a speech segment database 5, a speech synthesizer 6, and an output terminal 7.

Hereinbelow, description will be given of the operation of a conventional text-to-speech synthesizer. When Japanese Kanji and Kana mixed text information such as words and sentences (e.g., Kanji "left") is inputted from the input terminal 1, the text analyzer 2 converts the inputted text information "left" to reading information (e.g., "hidari") and outputs it. It is noted that input text is not limited to a Japanese Kanji and Kana mixed text, and so a reading symbol such as alphabet may be directly inputted.

The prosody generator 3 generates prosody information (information on pitch and volume of speech and speaking rate) based on the reading information "hidari" from the text analyzer 2. Here, information on the pitch of speech is set by pitch of a vowel (basic frequency), so that in the case of this example, pitches of vowels "i", "a", "i" are set in order of time. Also, information on the volume of speech and the speaking rate are set by an amplitude and duration of speech waveform per phoneme "h", "i", "d", "a", "r", "i". Thus-generated prosody information is sent to the speech segment selector 4 together with the reading information "hidari".

Eventually, the speech segment selector 4 refers to a speech segment database 5 for selecting speech segment data necessary for speech synthesis based on the reading information "hidari" from the prosody generator 3. Herein, examples of a widely-used speech synthesis unit include a Consonant+Vowel (CV) syllable unit (e.g., "ka", "gu"), and a Vowel+Consonant+Vowel (VCV) unit that holds characteristic quantity of a transient portion of syllabic concatenation for achieving high quality sound (e.g., "aki", "ito"). Hereinbelow, description will be made in the case of using the VCV unit as a basic unit of speech segment (speech synthesis unit).

In the speech segment database 5, there are stored, as the speech segment data, waveforms and parameters obtained by analyzing speech data appropriately taken out by VCV unit from, for example, speech data spoken by an announcer and by converting the form of the data to the form necessary for synthesis processing. In the case of general Japanese text-to-speech synthesis with use of VCV speech segment as a synthesis unit, approx. 800 VCV speech segment data sets are stored. When the reading information "hidari" is inputted in the speech segment selector 4 as in this example, the speech segment selector 4 selects speech segment data containing VCV segments "*hi", "ida", "ari", "i" from the speech segment database 5**. It is noted that a symbol "*" denotes silence. Thus-obtained selection result information is sent together with prosody information to the speech synthesizer 6.

Finally, the speech synthesizer 6 reads corresponding speech segment data from the speech segment database 5 based on the inputted selection result information. Then, based on the inputted prosody information and the above-obtained speech segment data, while the pitch and volume of speech and speaking rate being controlled in accordance with the prosody information, systems of the selected VCV speech segments are smoothly connected in vowel sections and outputted from the output terminal 7. Here, to the speech synthesizer 6, there are widely applied a method generally called waveform overlap-add technique (e.g., Japanese Patent Laid-Open Publication No. 60-21098) and a method generally called vocoder technique or formant synthesis technique (e.g., "Basic Speech Information Processing" P76–77 published by Ohmsha).

The above-stated text-to-speech synthesizer can increase the number of speech qualities (speakers) by changing voice pitch or speech segment database. Also, separate signal processing is applied to an outputted speech signal from the speech synthesizer 6 so as to achieve sound effects such as echoing. Further, it has been proposed that pitch conversion processing, that is also applied to Karaoke and the like, is applied to the output speech signal from the speech synthesizer 6, and an original synthetic speech signal and the pitch-converted speech signal are combined to implement simultaneous speaking by a plurality of speakers (e.g., Japanese Patent Laid-Open Publication No. 3-211597). Also, there has been proposed an apparatus in which the text analyzer 2 and the prosody generator 3 in the above text-to-speech synthesizer are driven by time sharing, and a plurality of speech output portions composed of the speech synthesizer 6 and the like are provided for simultaneously outputting a plurality of speeches corresponding to a plurality of texts (e.g., Japanese Patent Laid-Open Publication No. 6-75594).

In the above conventional text-to-speech synthesizer, changing the speech segment database makes it possible to switch speakers so that a specified text is spoken by various speakers. However, there is a problem that, for example, a plurality of speakers cannot speak the same speech content simultaneously.

Also, as disclosed in the Japanese Patent Laid-Open Publication No. 6-75594, the text analyzer 2 and the prosody generator 3 in the above text-to-speech synthesizer may be driven by time sharing, and a plurality of speech output portions composed of the speech synthesizer 6 and the like may be provided for simultaneously outputting a plurality of voices corresponding to a plurality of texts. However, there is a problem that pre-processing needs to be done by time sharing which leads to complication of the apparatus.

Also, as disclosed in the above Japanese Patent Laid-Open Publication No. 3-211597, the pitch conversion processing may be applied to the output speech signal from the speech synthesizer 6, and a fundamental synthetic speech signal and the pitch-converted speech signal enable a plurality of speakers to speak simultaneously. However, the pitch conversion processing needs processing generally called pitch extraction with a large processing amount, which causes a problem that such apparatus configuration brings about larger processing amount and large cost increase.

DISCLOSURE OF THE INVENTION

Accordingly, it is an object of the present invention to provide a text-to-speech synthesizer enabling a plurality of speakers to simultaneously speak the same text with easier processing, and a program storage medium for storing a text-to-speech synthesis processing program.

In order to achieve the above object, a text-to-speech synthesizer for selecting necessary speech segment information from speech segment database based on reading and word class information on input text information and generating a speech signal based on the selected speech segment information, comprising:

text analyzing means for analyzing the input text information and obtaining reading and word class information;

prosody generating means for generating prosody information based on the reading and the word class information;

plural speech instructing means for instructing simultaneous speaking of an identical input text by a plurality of voices; and plural speech synthesizing means for generating a plurality of synthesized speech signals based on prosody information from the prosody generating means and speech segment information selected from the speech segment database upon reception of an instruction from the plural speech instructing means.

According to the above configuration, reading information and prosody information are generated by the text analyzing means and the prosody generating means from one text information. Then, in accordance with the instruction from the plural speech instructing means, there is generated a plurality of synthetic speech signals by the plural speech synthesizing means based on the prosody information generated by one text information and the speech segment information selected from the speech segment database. Consequently, simultaneous output of a plurality of voices based on the identical input text can be achieved by easy processing without the necessity of adding time-sharing processing of the text analyzing means and the prosody generating means, pitch conversion processing, or the like.

In one embodiment of the present invention, the plural speech synthesizing means comprises:

waveform overlap-add means for generating a speech signal by waveform overlap-add technique based on the speech segment information and the prosody information;

waveform expanding/contracting means for expanding or contracting a time base of a waveform of the speech signal generated by the waveform overlap-add means based on the prosody information and the instruction information from the plural speech instructing means and generating a speech signal different in pitch of speech; and mixing means for mixing the speech signal from the waveform overlap-add means and the speech signal from the waveform expanding/contracting means.

According to this embodiment, a fundamental speech signal is generated by the waveform overlap-add means. The time base of the waveform of the fundamental speech signal is expanded or contracted by the waveform expanding/contracting means to generate an expanded/contracted speech signal. Then, by the mixing means, the fundamental speech signal and the expanded/contracted speech signal are mixed. Thus, for example, a male voice and a female voice based on the same input text are simultaneously outputted.

In one embodiment of the present invention, the plural speech synthesizing means comprises:

a first waveform overlap-add means for generating a speech signal by waveform overlap-add technique based on the speech segment information and the prosody information;

a second waveform overlap-add means for generating a speech signal by waveform overlap-add technique based on the speech segment information, the prosody information, and the instruction information from the plural speech instructing means at a basic cycle different from that of the first waveform overlap-add means; and mixing means for mixing the speech signal from the first waveform overlap-add means and the speech signal from the second waveform overlap-add means.

According to this embodiment, a first speech signal is generated by the first waveform overlap-add means based on the speech segment. A second speech signal different only in the basic cycle from the first speech signal is generated by the second waveform overlap-add means based on the speech segment. Then, by the mixing means, the first speech signal and the second speech signal are mixed. Thus, for example, a male voice and a male voice with higher pitch based on the same input text are simultaneously outputted.

Further, since the first waveform overlap-add means and the second waveform overlap-add means have the same basic configuration, it becomes possible to operate one waveform overlap-add means as the first waveform overlap-add means and the second waveform overlap-add means by time sharing, thereby enabling simple configuration and decreased costs.

In one embodiment of the present invention, the plural speech synthesizing means comprises:

a first waveform overlap-add means for generating a speech signal by waveform overlap-add technique based on the speech segment information and the prosody information;

a second speech segment database for storing speech segment information different from that stored in a first speech segment database as the speech segment database;

a second waveform overlap-add means for generating a speech signal by waveform overlap-add technique based on speech segment information selected from the second speech segment database, the prosody information, and instruction information from the plural speech instructing means; and mixing means for mixing the speech signal from the first waveform overlap-add means and the speech signal from the second waveform overlap-add means.

According to this working example, while, for example, male speech segment information is stored in the first speech segment database, female speech segment information is stored in the second speech segment database, which enables the second waveform overlap-add means to use speech segment information selected from the second speech segment database, thereby enabling simultaneous output of a female voice and a male voice based on the same input text.

In one embodiment of the present invention, the plural speech synthesizing means comprises:

waveform overlap-add means for generating a speech signal by waveform overlap-add technique based on the speech segment information and the prosody information;

waveform expanding/contracting overlap-add means for expanding or contracting a time base of a waveform of the speech signal based on the prosody information and the instruction information from the plural speech instructing means and generating a speech signal by the waveform overlap-add technique; and mixing means for mixing the speech signal from the waveform overlap-add means and the speech signal from the waveform expanding/contracting overlap-add means.

According to this embodiment, by the waveform overlap-add means, the speech segment is used to generate a fundamental speech signal. By the waveform expanding/contracting overlap-add means, the time base of the waveform of the speech segment is expanded or contracted, by which there is generated a speech signal whose pitch is different from that of the fundamental speech signal and whose frequency spectrum is deformed. Then, by the mixing means, the both speech signals are mixed. Thus, for example, a male speech and a female speech based on the same input text are simultaneously spoken.

In one embodiment of the present invention, the plural speech synthesizing means comprises:

first excitation waveform generating means for generating a first excitation waveform based on the prosody information;

second excitation waveform generating means for generating a second excitation waveform different in frequency from the first excitation waveform based on the prosody information and the instruction information from the plural speech instructing means;

mixing means for mixing the first excitation waveform and the second excitation waveform; and a synthetic filter for obtaining vocal tract articulatory feature parameters contained in the speech segment information and generating a synthetic speech signal based on the mixed excitation waveform with use of the vocal tract articulatory feature parameters.

According to this embodiment, a mixed excitation waveform of the first excitation waveform generated by the first excitation waveform generating means and the second excitation waveform different in frequency from the first excitation waveform generated by the second excitation waveform generating means is generated by the mixing means. Based on the mixed excitation waveform, with a synthetic filter of which filter vocal tract articulatory features are set by the vocal tract articulatory feature parameters contained in the selected speech segment information, a synthetic voice is generated. Thus, for example, voices with a plurality of voice pitches based on the same text are simultaneously output.

In one embodiment of the present invention, a plurality of the wave form expanding/contracting means, the second waveform overlap-add means, the waveform expanding/contracting overlap-add means, or the second excitation waveform generating means are present.

According to this embodiment, the number of speakers who speak simultaneously based on the same input text can be increased to three or more, resulting in generation of text synthetic voices full of variety.

In one embodiment of the present invention, the mixing means performs the mixing operation with a mixing ratio based on the instruction information from the plural speech instructing means.

According to this embodiment, it becomes possible to supply perspective to each of a plurality of speakers who speak simultaneously based on the same input text, which enables simultaneous speaking by a plurality of speakers corresponding to various situations.

Also, there is provided a program storage medium allowing read by a computer, characterized by storing a text-to-speech synthesis processing program for letting the computer function as:

the text analyzing means, the prosody generating means, the plural speech instructing means, and the plural speech synthesizing means.

According to the above configuration, as with the first invention, simultaneous output of a plurality of voices based on the same input text is implemented with easy processing without the necessity of adding time-sharing processing of the text analyzing means and the prosody generating means as well as pitch conversion processing.

BRIEF DESCRIPTION OF THE DRAWINGS

FIGS. 3A to 3C are views showing speech waveforms generated by each portion of the plural speech synthesizer shown in FIG. 2;

FIG. 4 is a block diagram showing the configuration of a plural speech synthesizer different from FIG. 2;

BEST MODE FOR CARRYING OUT THE INVENTION

Hereinbelow, the present invention will be described in detail in conjunction with the embodiments with reference to the drawings.

FIRST EMBODIMENT

Figure 1:
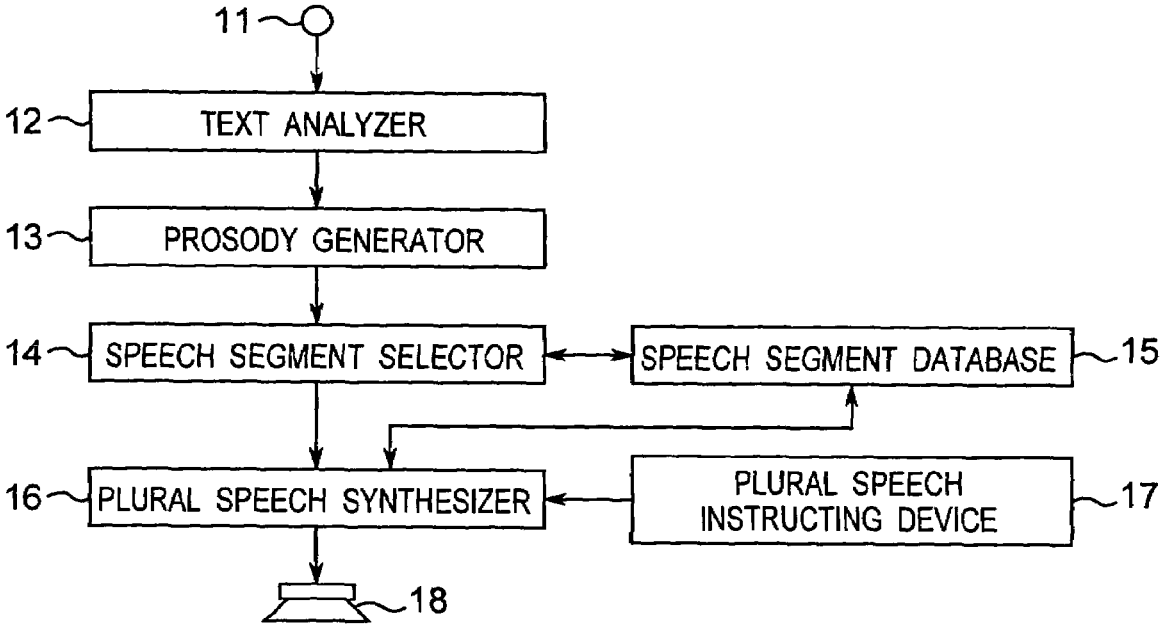
FIG. 1 is a block diagram showing a text-to-speech synthesizer in the present invention.

FIG. 1 is a block diagram showing a text-to-speech synthesizer in the present embodiment. The text-to-speech synthesizer is mainly composed of a text input terminal 11, a text analyzer 12, a prosody generator 13, a speech segment selector 14, a speech segment database 15, a plural speech synthesizer 16, a plural speech instructing device 17, and an output terminal 18.

Figure 11:
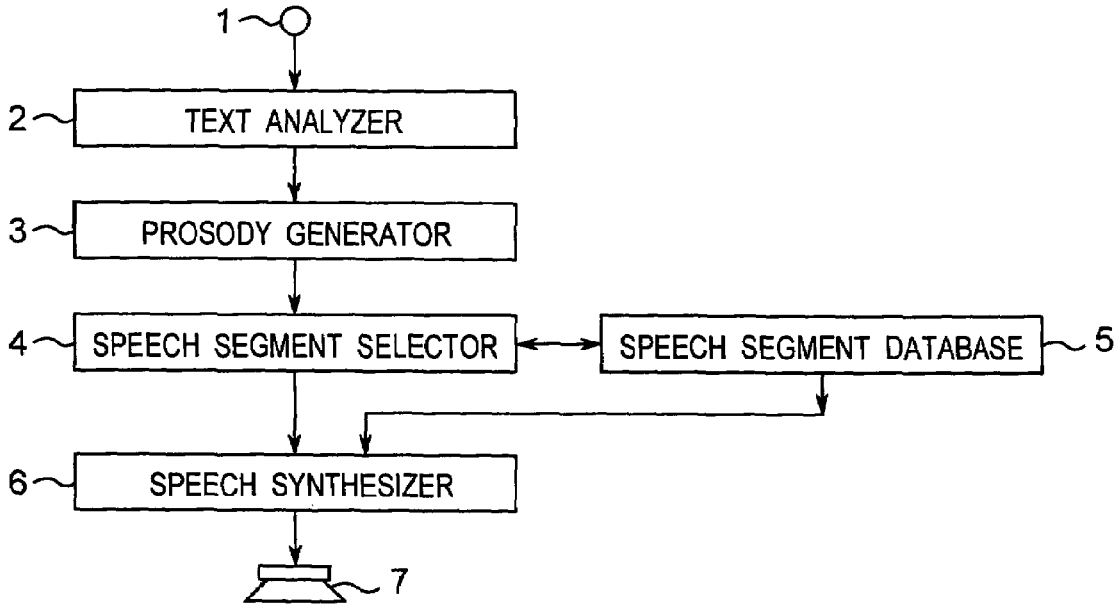
Fig.11 BACKGROUND ART
FIG. 11 is a block diagram showing the configuration of a text-to-speech synthesizer of a background art.

The text input terminal 11, the text analyzer 12, the prosody generator 13, the speech segment selector 14, the speech segment database 15, and the output terminal 18 are identical to a text input terminal 1, a text analyzer 2, a prosody generator 3, a speech segment generator 4, a speech segment database 5, and an output terminal 7 in the speech synthesizer of a background art shown in FIG. 11. More particularly, text information inputted from the input terminal 11 is converted to reading information by the text analyzer 12. Then, based on the reading information, prosody information is generated by the prosody generator 13, and based on the reading information, VCV speech segment is selected from the speech segment database 15 by the speech segment selector 14. The selection result information is sent together with the prosody information to the plural speech synthesizer 16.

The plural speech instructing device 17 instructs to the plural speech synthesizer 16 as for what kind of a plurality of voices should be simultaneously outputted. Consequently, the plural speech synthesizer 16 simultaneously synthesizes a plurality of speech signals in accordance with the instruction from the plural speech instructing device 17. This makes it possible to let a plurality of speakers simultaneously speak based on the same input text. For example, it becomes possible to let two speakers of a male voice and a female voice to say "Welcome" at the same time.

The plural speech instructing device 17, as described above, instructs to the plural speech synthesizer 16 as to what kind of voices should be outputted. Examples of the instruction in this case include a method for specifying a general pitch change rate against synthetic speech and a mixing ratio of a speech signal whose pitch is changed. For example, there is an instruction "mix a speech signal with an octave higher speech signal with an amplitude halved". It is noted that in the above example, description was given in the case where two voices are simultaneously outputted. However, although a processing amount and a size of database are increased, easy expansion to the simultaneous output of three or more voices is available.

The plural speech synthesizer 16 performs processing for simultaneously outputting a plurality of voices in accordance with the instruction from the plural speech instructing device 17. As described later, the plural speech synthesizer 16 can be implemented by partially expanding the processing of the speech synthesizer 6 in the text-to-speech synthesizer of a background art for outputting one voice shown in FIG. 11. Therefore, compared to the structure of adding the pitch conversion processing as post processing as in the case of the above Japanese Patent Laid-Open Publication No. 3-21159, it becomes possible to restrain increase of a processing amount in plural speech generation.

Figure 2:
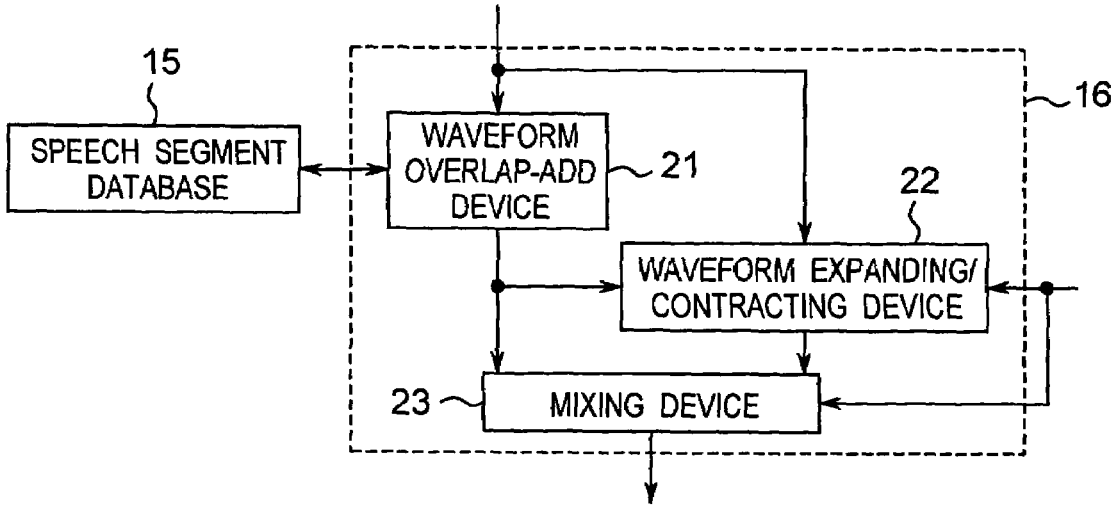
FIG. 2 is a block diagram showing one example of the configuration of the plural speech synthesizer in FIG. 1.

Hereinbelow, detailed description will be given of the configuration and operation of the plural speech synthesizer 16. FIG. 2 is a block diagram showing an example of the configuration of the plural speech synthesizer 16. In FIG. 2, the plural speech synthesizer 16 is composed of a waveform overlap-add device 21, a waveform expanding/contracting device 22, and a mixing device 23. The waveform overlap-add device 21 reads speech segment data selected by the speech segment selector 14, and generates a speech signal by waveform overlap-add technique based on the speech segment data and the prosody information from the speech segment selector 14. Then, the generated speech signal is sent to the waveform expanding/contracting device 22 and the mixing device 23. Consequently, the waveform expanding/contracting device 22 expands or contracts a time base of a waveform of the speech signal from the waveform overlap-add device 21 so as to change voice pitch based on the prosody information from the speech segment selector 14 and the instruction from the plural speech instructing device 17 for changing pitch of the voice. Then the expanded or contracted speech signal is sent to the mixing device 23. The mixing device 23 mixes the fundamental speech signal from the waveform overlap-add device 21 and the expanded or contracted speech signal from the waveform expanding/contracting device 22, and outputs a resultant speech signal to the output terminal 18.

In the above configuration, in the processing for generating synthetic speech in the waveform overlap-add device 21, there is used waveform overlap-add technique disclosed, for example, in Japanese Patent Laid-Open Publication No. 60-21098. In this waveform overlap-add technique, a speech segment is stored in the speech segment database 15 as a waveform of a basic cyclic unit. The waveform overlap-add device 21 generates a speech signal by repeatedly generating the waveform at time intervals corresponding to a specified pitch. There have been developed various methods for implementing waveform overlap-add processing such as a method in which when the repeated interval is longer than the fundamental frequency of a speech segment, "0" data is filled in a deficient portion, whereas when the repeated interval is shorter, a window is appropriately applied so as to prevent the edge portion of the waveform from changing rapidly before terminating the processing.

Next, description will be given of processing executed by the waveform expanding/contracting device 22 for changing voice pitch of the fundamental speech signal generated by the waveform overlap-add technique. Herein, since the processing for changing voice pitch is applied to an output signal of the text-to-speech synthesis in the prior art disclosed in the above-stated Japanese Patent Laid-Open Publication No. 3-211597, pitch extraction processing is necessary. Contrary to this, in the present embodiment, there is used pitch information contained in the prosody information inputted to the plural speech synthesizer 16, which makes it possible to omit the pitch extraction processing, thereby enabling efficient implementation.

FIG. 3 shows speech waveforms generated by each portion of the plural speech synthesizer 16 in the present embodiment. Hereinbelow, with reference to FIG. 3, the processing for changing voice pitch will be described. FIG. 3A shows a speech waveform in a vowel section generated by the waveform overlap-add technique by the waveform overlap-add device 21. The waveform expanding/contracting device 22 performs waveform expansion/contraction of the speech waveform of FIG. 3A generated by the waveform overlap-add device 21 per basic cycle A based on pitch information that is one of the prosody information from the speech segment selector 14 and information on a pitch change rate instructed from the plural speech instructing device 17. As a result, there is obtained, as shown in FIG. 3B, a speech waveform whose overall outline is expanded/contracted in time base direction. Herein, for raising a pitch so as to prevent the total duration from being changed by expansion/contraction, a waveform of basic cyclic unit is appropriately repeated for more times, whereas for lowering a pitch, the waveform is thinned out. In the case of FIG. 3B, since the waveform is contracted by shortening the basic cycle, the pitch is raised compared to the speech waveform of FIG. 3A, and therefore there is provided a signal whose frequency spectrum is expanded to higher band. For example for easy understanding of the effect thereof, based on a synthetic male-voice speech signal as the fundamental speech signal, a synthetic female-voice speech signal is generated as the speech signal contracted as shown above by the waveform expanding/contracting device 22.

Next, in conformity with a mixing ratio given by the plural speech instructing device 17, the mixing device 23 mixes two speech waveforms: the speech waveform of FIG. 3A generated by the waveform overlap-add device 21; and the speech waveform of FIG. 3B generated by the waveform expanding/contracting device 22. FIG. 3C shows an example of the speech waveform obtained as a mixing result. Thus, simultaneous speaking by two speakers based on the same text is implemented.

As described above, in the present embodiment, there are provided the plural speech synthesizer 16 and the plural speech instructing device 17. Further, the plural speech synthesizer 16 is composed of the waveform overlap-add device 21, the waveform expanding/contracting device 22, and the mixing device 23. And the plural speech instructing device 17 instructs to the plural speech synthesizer 16 a change rate of pitch (pitch changing rate) compared to a fundamental synthetic speech signal and a mixing ratio of the speech signal whose pitch is changed.

Accordingly, based on the speech segment data read from the speech segment database 15 and the prosody information from the speech segment selector 14, the waveform overlap-add device 21 generates a fundamental speech signal by waveform overlap-add processing. Meanwhile, based on the prosody information from the speech segment selector 14 and the instruction from the plural speech instructing device 17, the waveform expanding/contracting device 22 expands or contracts the time base of the waveform of the fundamental speech signal for changing voice pitch. Then, the mixing device 23 mixes the fundamental speech signal from the waveform overlap-add device 21 and the expanded/contracted speech signal from the waveform expanding/contracting device 22, and outputs a resultant signal to the output terminal 18.

Therefore, the text analyzer 12 and the prosody generator 13 execute text analysis processing and prosody generation processing of one input text information without performing time-sharing processing. Also, it is not necessary to add pitch conversion processing as post-processing of the plural speech synthesizer 16. More specifically, according to the present embodiment, simultaneous speaking of synthetic speech by a plurality of speakers based on the same text may be implemented with easier processing and a simpler apparatus.

SECOND EMBODIMENT

Following description discusses another embodiment of the plural speech synthesizer 16. FIG. 4 is a block diagram showing the configuration of the plural speech synthesizer 16 in the present embodiment. The present plural speech synthesizer 16 is composed of a first waveform overlap-add device 25, a second waveform overlap-add device 26, and a mixing device 27. Based on the speech segment data read from the speech segment database 15 and the prosody information from the speech segment selector 14, the first waveform overlap-add device 25 generates a speech signal by the waveform overlap-add processing and sends it to the mixing device 27. The second waveform overlap-add device 26 changes a pitch that is one of the prosody information from the speech segment selector 14 based on a pitch change rate instructed from the plural speech instructing device 17. Then, based on the speech segment data identical to the speech segment data used by the first waveform overlap-add device 25 and the changed pitch, a speech signal is generated by waveform overlap-add processing. Then, the generated speech signal is sent to the mixing device 27. The mixing device 27 mixes two speech signals: the fundamental speech signal from the first waveform overlap-add device 25; and the speech signal from the second waveform overlap-add device 26 in accordance with a mixing ratio from the plural speech instructing device 17, and outputs a resultant speech signal to the output terminal 18.

It is noted that synthetic speech generation processing by the first waveform overlap-add device 25 is similar to the processing by the waveform overlap-add device 21 of the above first embodiment. Also, synthetic speech generation processing by the second waveform overlap-add device 26 is a general waveform overlap-add processing similar to the processing by the waveform overlap-add device 21 except the point that the pitch is changed in accordance with a pitch change rate from the plural speech instructing device 17. Therefore, in the case of the plural speech synthesizer 16 in the first embodiment, there is provided a waveform expanding/contracting device 22 different in configuration from the waveform overlap-add device 21, which necessitates separate processing for expanding/contracting the waveform to a specified basic cycle. However, in the present embodiment, since two waveform overlap-add devices 25, 26 having the same basic functions are used, using the first waveform overlap-add device 25 twice by time-sharing processing makes it possible to delete the second waveform overlap-add device 26 in an actual configuration, which makes it possible to simplify the configuration and reduce costs.

Figure 5A:
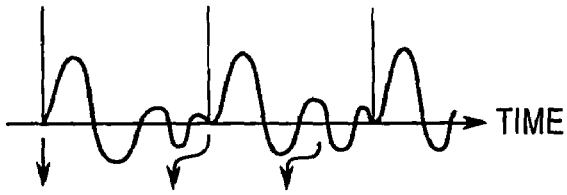
FIGS. 5A to 5C re views showing speech waveforms generated by each portion of the plural speech synthesizer shown in FIG. 4.
Figure 5B:
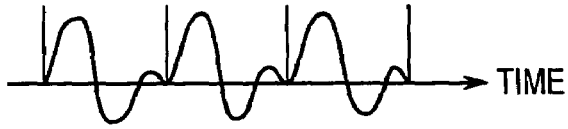

FIG. 5 shows speech signal waveforms generated by each portion in the present embodiment. Hereinbelow, with reference to FIG. 5, speech signal generation processing will be described. FIG. 5A shows a speech waveform in a vowel section generated by the fundamental waveform overlap-add technique by the first waveform overlap-add device 25. FIG. 5B is a speech waveform generated by the second waveform overlap-add device 26 with a pitch different from the fundamental pitch with use of the pitch changed in conformity with a pitch change rate instructed from the plural speech instructing device 17. In this example, a speech signal whose pitch is higher than normal pitch is generated. It is noted that as shown in FIG. 5B, the speech signal generated by the second waveform overlap-add device 26 is changed in pitch from the speech signal of FIG. 5A, but waveform expansion/contraction is not applied thereto, so that the frequency spectrum thereof is identical to the fundamental speech signal by the first waveform overlap-add device 25. For example for easy understanding of the effect thereof, based on a synthetic male-voice speech signal as the fundamental speech signal, a synthetic male-voice speech signal whose pitch is raised by the second waveform overlap-add device 26 is generated.

Figure 5C:
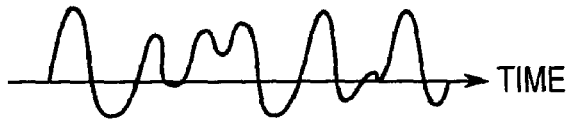

Next, the mixing device 27 mixes two speech waveforms: the speech waveform of FIG. 5A generated by the first waveform overlap-add device 25; and the speech waveform of FIG. 5B generated by the second waveform overlap-add device 26 in accordance with a mixing ratio given from the plural speech instructing device 17. FIG. 5C shows an example of the speech waveform obtained as a mixing result. Thus, simultaneous speaking by two speakers based on the same txt is implemented.

As described above, in the present embodiment, the plural speech synthesizer 16 is composed of the first waveform overlap-add device 25, the second waveform overlap-add device 26, and the mixing device 27. The fundamental speech signal is generated by the first waveform overlap-add device 25 based on the speech segment data read from the speech segment database 15. The speech signal is generated by the second waveform overlap-add device 26 in the waveform overlap-add processing based on the speech segment data with use of a pitch obtained by changing the pitch from the speech segment selector 14 in accordance with the pitch change rate from the plural speech instructing device 17. Then, the mixing device 27 mixes two speech signals from the both waveform overlap-add devices 25, 26, and outputs a resultant signal to the output terminal 18. This enables simultaneous speaking by two speakers based on the same text with easy processing.

Also, according to the present embodiment, since two waveform overlap-add devices 25, 26 having the same basic functions are used, using the first waveform overlap-add device 25 twice by time-sharing processing makes it possible to delete the second waveform overlap-add device 26, which makes it possible to simplify the configuration and reduce costs compared to the first embodiment.

THIRD EMBODIMENT

Figure 6:
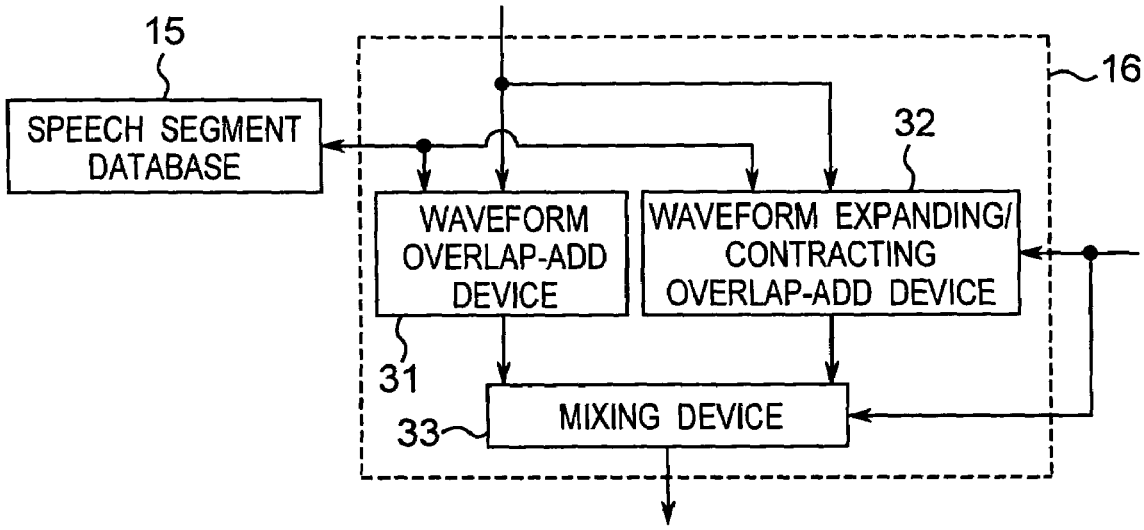
FIG. 6 is a block diagram showing the configuration of a plural speech synthesizer different from FIG. 2 and FIG. 4.

FIG. 6 is a block diagram showing the configuration of the plural speech synthesizer 16 in the present embodiment. The plural speech synthesizer 16 is composed of a waveform overlap-add device 31, a waveform expanding/contracting overlap-add device 32, and a mixing device 33. Based on the speech segment data read from the speech segment database 15 and the prosody information from the speech segment selector 14, the waveform overlap-add device 31 generates a speech signal by the waveform overlap-add processing and sends it to the mixing device 33. The waveform expanding/contracting overlap-add device 32 generates a speech signal by expanding or contracting a waveform of the speech segment read from the speech segment database 15 and identical to that used by the waveform overlap-add device 31, to a time interval corresponding to a specified pitch in accordance with the pitch change rate instructed from the plural speech instructing device 17, and by repeatedly generating the expanded/contracted waveform. Examples of the expanding/contracting method in this case include linear interpolation method. More specifically, in the present embodiment, the waveform expanding/contracting function is imparted to the waveform overlap-add device itself for expanding/contracting the waveform of a speech segment in the process of waveform overlap-add processing.

Thus-generated speech signal is sent to the mixing device 33. Then, the mixing device 33 mixes two speech signals: the fundamental speech signal from the waveform overlap-add device 31; and the expanded/contracted speech signal from the waveform expanding/contracting overlap-add device 32 based on a mixing ratio given from the plural speech instructing device 17, and outputs a resultant signal to the output terminal 18.

The waveform of the speech signal generated by the waveform overlap-add device 31, the waveform expanding/contracting overlap-add device 32, and the mixing device 33 in the plural speech synthesizer 16 of the present embodiment is identical to that of FIG. 3. It is noted that the pitch of the speech signal outputted from the second waveform overlap-add device 26 of the second embodiment is changed but the frequency spectrum thereof is unchanged, which results in outputting a plurality of voices similar in voice quality to each other. Contrary to this, the frequency spectrum of the speech signal outputted from the waveform expanding/contracting overlap-add device 32 of the present embodiment is changed either.

FOURTH EMBODIMENT

Figure 7:
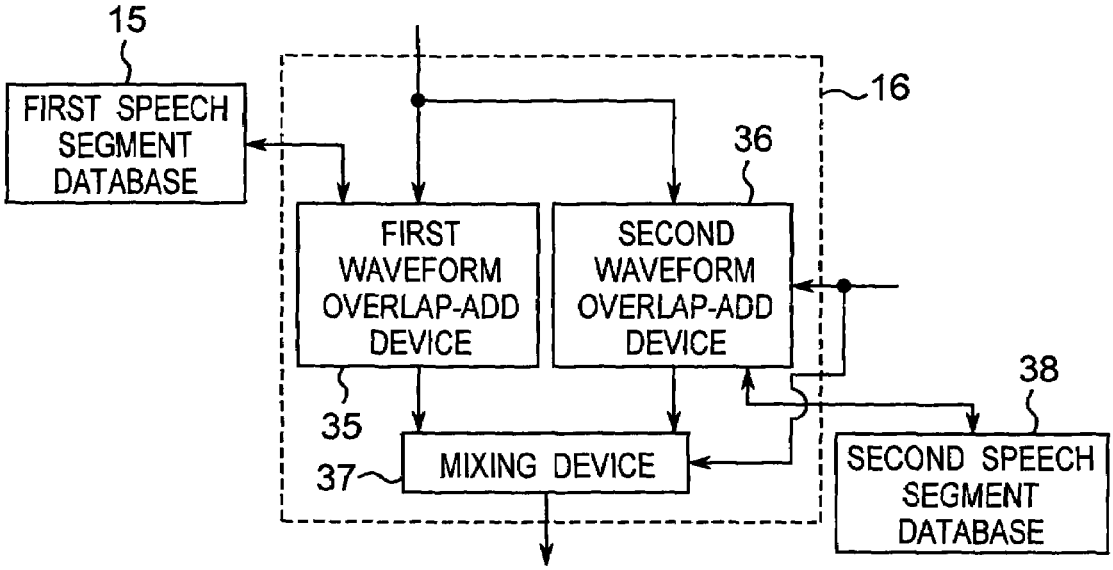
FIG. 7 is a block diagram showing the configuration of a plural speech synthesizer different from FIG. 2, FIG. 4, and FIG. 6.

FIG. 7 is a block diagram showing the configuration of the plural speech synthesizer 16 in the present embodiment. As with the second embodiment, the plural speech synthesizer 16 is composed of a first waveform overlap-add device 35, a second waveform overlap-add device 36, and a mixing device 37. Further in the present embodiment, speech segment database dedicated for the second waveform overlap-add device 36 is provided independently of the speech segment database 15 used by the first waveform overlap-add device 35. Hereinbelow, the speech segment database 15 used by the first waveform overlap-add device 35 is called first speech segment data base, while the speech segment database used by the second waveform overlap-add device 36 is called a second speech segment database 38.

In the above-described first to third embodiments, there is used only the speech segment database 15 generated by the voice of one speaker. However, in the present embodiment, the second speech segment database 38 generated by a speaker different from the speaker of the speech segment database 15 is provided and used by the second waveform overlap-add device 36. In the case of this embodiment, there are used two kinds of speech databases 15, 38 essentially different in voice quality from each other, which enables simultaneous speaking by a plurality of voice qualities full of variations more than any other above-stated embodiments.

It is noted that in this case, the plural speech instructing device 17 outputs an instruction for performing a plurality of speech synthesis with use of a plurality of speech segment databases. For example, there is outputted an instruction: "use data on a male speaker for generation of a normal synthetic voice and use a different database on a female speaker for generation of another synthetic voice, and mix these two voices at the same ratio".

Figure 8A:
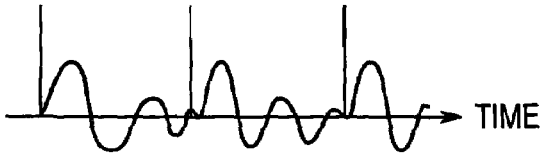
FIGS. 8A to 8C are views showing speech waveforms generated in each part of the plural speech synthesizer shown in FIG. 7.
Figure 8B:
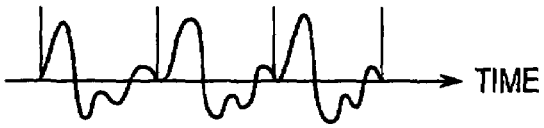
Figure 8C:
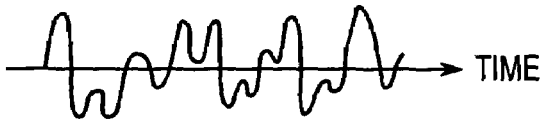

FIG. 8 shows speech waveforms generated in each part of the plural speech synthesizer 16 in the present embodiment. Hereinbelow, with reference to FIG. 8, speech signal generation processing will be described. FIG. 8A shows a fundamental speech waveform generated by the first waveform overlap-add device 35 with use of the first speech segment database 15. FIG. 8B shows a speech signal waveform with a pitch higher than that of the fundamental speech signal waveform generated by the second waveform overlap-add device 36 with use of the second speech segment database 38. FIG. 8C shows a speech waveform obtained by mixing these two speech waveforms. It is noted that in this case, the first speech segment database 15 is generated from a male speaker while the second speech segment database 38 is generated from a female speaker so as to enable generation of a female voice without executing expansion/contraction processing of the waveform in the second waveform overlap-add device 36.

FIFTH EMBODIMENT

Figure 9:
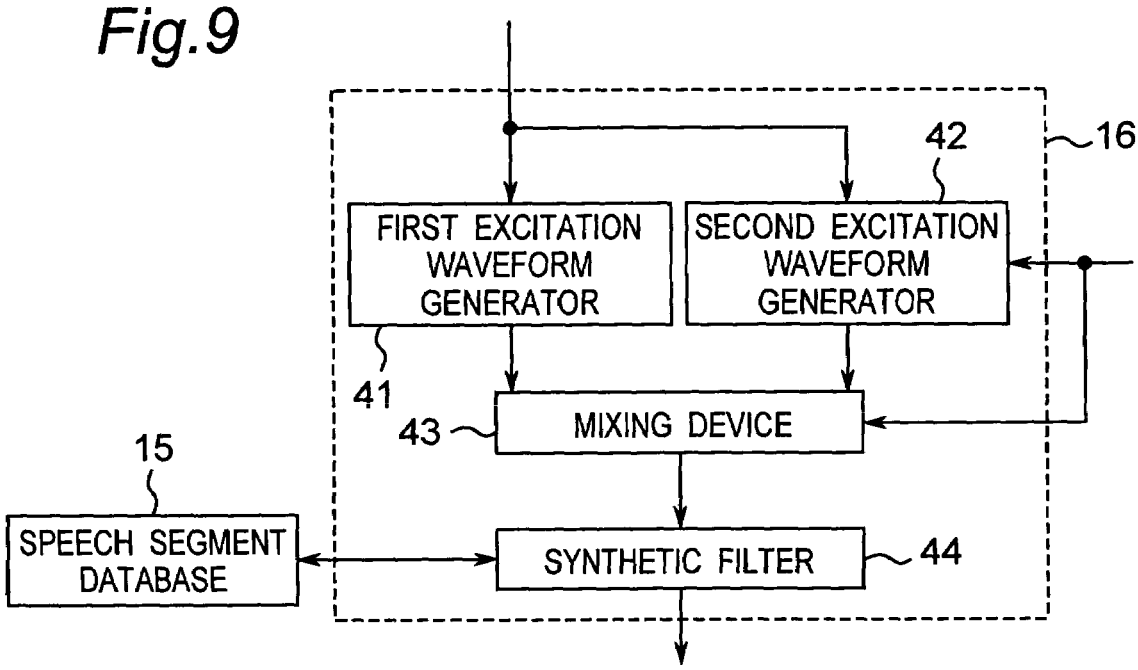
FIG. 9 is a block diagram showing the configuration of a plural speech synthesizer different from FIG. 2, FIG. 4, FIG. 6, and FIG. 7.
Figure 10A:
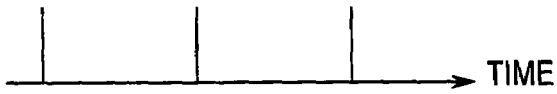
FIGS. 10A to 10D are views showing speech waveforms generated in each part of the plural speech synthesizer shown in FIG. 9.
Figure 10B:
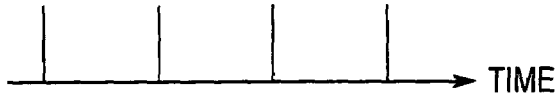
Figure 10C:
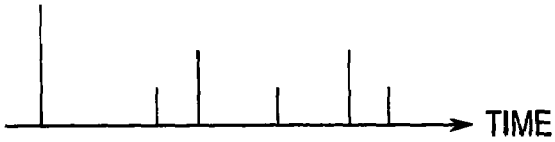
Figure 10D:
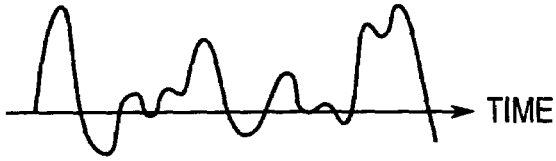

FIG. 9 is a block diagram showing the configuration of the plural speech synthesizer 16 in the present embodiment. The plural speech synthesizer 16 is composed of a first excitation waveform generator 41, a second excitation waveform generator 42, a mixing device 43, and a synthetic filter 44. The first excitation waveform generator 41 generates a fundamental excitation waveform based on a pitch that is one of the prosody information from the speech segment selector 14. Also, the second excitation waveform generator 42 changes the pitch based on a pitch change rate instructed from the plural speech instructing device 17. Then, based on the changed pitch, an excitation waveform is generated. Also, the mixing device 43 mixes two excitation waveforms from the first and second excitation waveform generators 41, 42 in conformity with a mixing ratio from the plural speech instructing device 17 to generate a mixed excitation waveform. The synthetic filter 44 obtains parameters that represent vocal tract articulatory features contained in the speech segment data from the speech segment database 15. Then, with use of the vocal tract articulatory feature parameters, a speech signal is generated based on the mixed excitation waveform.

More specifically, the plural speech synthesizer 16 executes speech synthesis processing by the vocoder technique to generate an excitation waveform in which a section of voiced sounds such as vowels is composed of a pulse string of an interval corresponding to a pitch, whereas a section of unvoiced sounds such as frictional consonants is compose of white noise. Then, the excitation waveform is passed through the synthetic filter which gives vocal tract articulatory features corresponding to a selected speech segment for generating a synthetic speech signal.

FIG. 10 shows speech waveforms generated in each part of the plural speech synthesizer 16 in the present embodiment. Hereinbelow, with reference to FIG. 10, speech signal generation processing in the present embodiment will be described. FIG. 10A shows a fundamental excitation waveform generated by the first excitation waveform generator 41. FIG. 10B is an excitation waveform generated by the second excitation waveform generator 42. In the case of this example, the excitation waveform is generated based on a pitch change rate instructed from the plural speech instructing device 17 to have a pitch higher than a normal pitch obtained by changing the pitch from the speech segment selector 14. The mixing device 43 mixes these two excitation waveforms in conformity with a mixing ratio from the plural speech instructing device 17 to generate a mixed excitation waveform as shown in FIG. 10C. FIG. 10D shows a speech signal obtained by inputting the mixed excitation waveform into the synthetic filter 44.

In the speech segment databases 15, 38 in each of the above embodiments, there are stored speech segment waveform data for waveform overlap-add processing. Contrary to this, in the speech segment database 15 by the vocoder technique in the present embodiment, there is stored data on vocal tract articulatory feature parameters (e.g., linear prediction parameters) of each speech segment.

As described above, in the present embodiment, the plural speech synthesizer 16 is composed of the first excitation waveform generator 41, the second excitation waveform generator 42, the mixing device 43, and the synthetic filter 44. A fundamental excitation waveform is generated by the first excitation waveform generator 41. An excitation waveform is generated by the second excitation waveform generator 42 with use of a pitch obtained by changing the pitch from the speech segment selector 14 based on the pitch change rate from the plural speech instructing device 17. Then, two excitation waveforms from the both excitation waveform generators 41, 42 are mixed by the mixing device 43, and the mixed excitation waveform is passed through the synthetic filter 44 of which the vocal tract articulatory features are set corresponding to the selected speech segment, by which a synthetic speech signal is generated.

Therefore, according to the present embodiment, it becomes possible to implement simultaneous speaking of synthetic speech by a plurality of speakers based on the same text with easy processing without executing the text analysis processing and the prosody generation processing by time sharing or adding the pitch conversion processing as post-processing.

It is noted that in each of the above-stated embodiments, the above processing is not applied to the section of unvoiced sounds such as frictional consonants, and a synthetic speech signal of only one speaker is generated therein. More specifically, signal processing for implementing simultaneous speaking by two speakers is applied only to the section of voiced sounds where pitch is present. Also, there may be provided a plurality of the waveform expanding/contracting devices 22 of the first embodiment, the second waveform overlap-add devices 26 of the second embodiment, the waveform expanding/contracting overlap-add devices 32 of the third embodiment, the second waveform overlap-add devices 36 of the fourth embodiment, and second excitation waveform generators 42 of the fifth embodiment, so that the number of speakers who simultaneously speak based on the same input text may be increased to three or more.

The functions of the text analyzing means, the prosody generating means, the plural speech instructing means, the plural speech generating means and the plural speech synthesizing means in each of the above-stated embodiments are implemented by a text-to-speech synthesis processing program stored in a program storage medium. The program storage medium is a program medium composed of ROM (Read Only Memory). Alternatively, the program storage medium may be a program medium read in the state of being mounted on an external auxiliary memory. In either case, a program reading means for reading the text-to-speech synthesis processing program from the program medium may be structured to directly access the program medium for reading the program, or may be structured to download the program to a program storage area (unshown) provided in RAM (Random Access Memory) and read out the program by accessing the program storage area. It is noted that a download program for downloading the program from the program medium to the program storage area in the RAM is stored in advance in the apparatus mainbody.

Herein, the program medium is a medium structured detachably from the mainbody side for statically holding a program, the medium including: tape media such as magnetic tapes and cassette tapes; disk media including magnetic disks such as floppy disks and hard disks, and optical disks such as CD (Compact Disk)-ROM, MO (Magneto Optical) disks, MD (Mini Disk), and DVD (Digital Video Disk); card media such as IC (Integrated Circuit) cards and optical cards; and semiconductor memory media such as mask ROM, EPROM (Ultraviolet-Erasable Programmable Read-Only Memory), EEPROM (Electrically Erasable Programmable Read-Only Memory), and flash ROM.

Also, if the text-to-speech synthesizer in each of the above embodiment is provided with a modem and structured to be connectable to communication networks including Internet, the program medium may be a medium for dynamically holding the program by downloading from the communication networks and the like. It is noted that in this case, a download program for downloading the program from the communication network is stored in advance in the apparatus mainbody, or the download program may be installed from other storage media.

It is noted that those stored in the storage medium are not limited to programs, and therefore data may be also stored therein.

The invention claimed is:

1. A text-to-speech synthesizer for selecting necessary speech segment information from speech segment database based on reading and word class information on input text information and generating a speech signal based on the selected speech segment information, comprising:

text analyzing means for analyzing the input text information and obtaining reading and word class information;

prosody generating means for generating prosody information based on the reading and the word class information;

plural speech instructing means for instructing simultaneous speaking of an identical input text by a plurality of voices; and plural speech synthesizing means for generating a plurality of synthesized speech signals based on prosody information from the prosody generating means and speech segment information selected from the speech segment database upon reception of an instruction from the plural speech instructing means.

2. The text-to-speech synthesizer as defined in claim 1, wherein the plural speech synthesizing means comprises:

waveform overlap-add means for generating a speech signal by waveform overlap-add technique based on the speech segment information and the prosody information;

waveform expanding/contracting means for expanding or contracting a time base of a waveform of the speech signal generated by the waveform overlap-add means based on the prosody information and the instruction information from the plural speech instructing means and generating a speech signal different in pitch of speech; and mixing means for mixing the speech signal from the waveform overlap-add means and the speech signal from the waveform expanding/contracting means.

3. The text-to-speech synthesizer as defined in claim 1, wherein the plural speech synthesizing means comprises:

a first waveform overlap-add means for generating a speech signal by waveform overlap-add technique based on the speech segment information and the prosody information;

a second waveform overlap-add means for generating a speech signal by waveform overlap-add technique based on the speech segment information, the prosody information, and the instruction information from the plural speech instructing means at a basic cycle different from that of the first waveform overlap-add means; and mixing means for mixing the speech signal from the first waveform overlap-add means and the speech signal from the second waveform overlap-add means.

4. The text-to-speech synthesizer as defined in claim 1, wherein the plural speech synthesizing means comprises:

a first waveform overlap-add means for generating a speech signal by waveform overlap-add technique based on the speech segment information and the prosody information;

a second speech segment database for storing speech segment information different from that stored in a first speech segment database as the speech segment database;

a second waveform overlap-add means for generating a speech signal by waveform overlap-add technique based on speech segment information selected from the second speech segment database, the prosody information, and instruction information from the plural speech instructing means; and mixing means for mixing the speech signal from the first waveform overlap-add means and the speech signal from the second waveform overlap-add means.

5. The text-to-speech synthesizer as defined in claim 1, wherein the plural speech synthesizing means comprises:

waveform overlap-add means for generating a speech signal by waveform overlap-add technique based on the speech segment information and the prosody information;

waveform expanding/contracting overlap-add means for expanding or contracting a time base of a waveform of the speech signal based on the prosody information and the instruction information from the plural speech instructing means and generating a speech signal by the waveform overlap-add technique; and mixing means for mixing the speech signal from the waveform overlap-add means and the speech signal from the waveform expanding/contracting overlap-add means.

6. The text-to-speech synthesizer as defined in claim 1, wherein the plural speech synthesizing means comprises:

first excitation waveform generating means for generating a first excitation waveform based on the prosody information;

second excitation waveform generating means for generating a second excitation waveform different in frequency from the first excitation waveform based on the prosody information and the instruction information from the plural speech instructing means;

mixing means for mixing the first excitation waveform and the second excitation waveform; and a synthetic filter for obtaining vocal tract articulatory feature parameters contained in the speech segment information and generating a synthetic speech signal based on the mixed excitation waveform with use of the vocal tract articulatory feature parameters.

7. The text-to-speech synthesizer as defined in claim 2, further comprising a plurality of the waveform expanding/contracting means.

8. The text-to-speech synthesizer as defined in claim 3, further comprising a plurality of the second waveform overlap-add means.

9. The text-to-speech synthesizer as defined in claim 4, further comprising a plurality of the second waveform overlap-add means.

10. The text-to-speech synthesizer as defined in claim 5, further comprising a plurality of the waveform expanding/contracting overlap-add means.

11. The text-to-speech synthesizer as defined in claim 6, further comprising a plurality of the second excitation waveform generating means.

12. The text-to-speech synthesizer as defined in claim 2, wherein the mixing means performs the mixing operation with a mixing ratio based on the instruction information from the plural speech instructing means.

13. The text-to-speech synthesizer as defined in claim 3, wherein the mixing means performs the mixing operation with a mixing ratio based on the instruction information from the plural speech instructing means.

14. The text-to-speech synthesizer as defined in claim 4, wherein the mixing means performs the mixing operation with a mixing ratio based on the instruction information from the plural speech instructing means.

15. The text-to-speech synthesizer as defined in claim 5, wherein the mixing means performs the mixing operation with a mixing ratio based on the instruction information from the plural speech instructing means.

16. The text-to-speech synthesizer as defined in claim 6, wherein the mixing means performs the mixing operation with a mixing ratio based on the instruction information from the plural speech instructing means.

17. A computer readable program storage medium, storing a text-to-speech synthesis processing program for causing the computer, having the text analyzing means the prosody generating means the plural speech instructing means, and the plural speech synthesizing means to perform the functions as defined in claim 1.

18. A computer readable program storage medium. storing a text-to-speech synthesis processing program for causing a computer to perform the steps of:

analyzing input text information and obtaining reading and word class information;

generating prosody information based on the reading and the word class information;

instructing simultaneous speaking of an identical input text by a plurality of voices;

generating a plurality of synthesized speech signals based on prosody information and speech segment information selected from a speech segment database upon reception of an instruction.

* * * * *